US006038910A

United States Patent [19]

McClung

[11] Patent Number: 6,038,910

[45] Date of Patent: Mar. 21, 2000

[54] METHOD AND APPARATUS FOR FORMING TAPERED METAL CONTAINER BODIES

[75] Inventor: James A. McClung, North Canton, Ohio

[73] Assignee: Can Industry Products, Inc., Canton, Ohio

[21] Appl. No.: 09/223,500

[22] Filed: Dec. 30, 1998

[51] Int. Cl.[7] ..... B21D 22/28

[52] U.S. Cl. ..... 72/348; 72/379.4

[58] Field of Search ..... 72/348, 379.4

[56] References Cited

U.S. PATENT DOCUMENTS

| | | | |
|---|---|---|---|
| 1,183 | 6/1839 | Tibbets . | |
| 4,051,707 | 10/1977 | Valek et al. | 72/348 |
| 4,366,696 | 1/1983 | Durgin et al. | 72/339 |
| 4,503,702 | 3/1985 | Bulso, Jr. et al. | 72/349 |
| 4,782,685 | 11/1988 | Bulso, Jr. et al. | 72/349 |
| 4,901,557 | 2/1990 | Schmidt | 72/370.08 |
| 4,914,937 | 4/1990 | Bulso, Jr. et al. | 72/349 |
| 5,014,536 | 5/1991 | Saunders | 72/348 |
| 5,626,048 | 5/1997 | McClung | 72/336 |

*Primary Examiner*—Lowell A. Larson
*Attorney, Agent, or Firm*—Sand & Sebolt

[57] ABSTRACT

A method and apparatus for forming tapered metal container bodies from relatively hard material having a Rockwell hardness within the range of 73 and 79. A disc-shaped blank is formed into a cup having an integral bottom wall and cylindrical sidewall, wherein the sidewall has an axial height generally equal to one-half the axial height of the desired final container body without thinning the metal. The cup is then redrawn at a first redraw station to form a first stage container body having the desired axial height and bottom wall diameter with the sidewall being cylindrical or having a very slight taper. This first stage container body is then redrawn at a second redraw station to impart a taper of between 2° and 4° to the sidewall without affecting the axial height of the sidewall or the metal thickness thereof. The apparatus includes a draw station and at least two redrawn stations and may include a die for profiling the bottom wall of the final container body.

21 Claims, 4 Drawing Sheets

METHOD AND APPARATUS FOR FORMING TAPERED METAL CONTAINER BODIES

BACKGROUND OF THE INVENTION

1. Technical Field

The invention relates to tapered metal container bodies such as used for food and beverages, and in particular to a tapered metal container body providing nesting or stacking thereof for economies of transportation. More particularly, the invention relates to such a method and apparatus for forming tapered metal container bodies from a metal strip formed of a harder and thinner material than heretofore used for forming such container bodies resulting in reduced cost.

2. Background Information

It is well known in the container forming art to form two-piece metal containers, that is, containers in which the walls and bottom of the containers or container bodies are a one-piece member and the top or end closure is a separate piece, wherein the members are formed by stamping disc-shaped blanks from a strip of metal and then subsequently drawing and redrawing the metal into the desired configuration from the metal blank.

These two piece containers have found great acceptance in the can industry and are used for a vast number of food products and beverages. The container bodies in many manufacturing operations, as well as the top end closures, are generally formed at a location distant from the food processing or beverage plant and are shipped to remote sites for subsequent filling with the end product. Small top end closures are generally flat. A great number can be shipped in relatively small volume containers. However, the container bodies occupy a relatively large space, most of which is unused space in the interior of the container body. This results in substantial shipping costs. Therefore, to reduce the shipping cost, container bodies have been tapered so they can be placed in a nested relationship enabling a considerable greater number of container bodies to be shipped in the same space heretofore required for a considerably less number of non-nested container bodies. This nesting problem is addressed and examples of such nestable containers are shown in U.S. Pat. Nos: 3,814,040; 4,366,696; and 4,503,702.

These container bodies which include the heretofore common straight cylindrical sidewall configuration or the newer tapered sidewall configuration, are mass produced in quantities of millions. Thus, a savings of only a fraction of a cent per container can save the can manufacturer and food processor a considerable amount of money. Therefore, it is desirable to form the container with as lightweight of metal as possible to reduce material cost without sacrificing the integrity of the formed container. However, it has been found that it is difficult to form tapered metal containers with a uniform sidewall thickness without wrinkling of the container body during draw and redraw operations. One method of reducing this wrinkling problem is described in U.S. Pat. No. 4,503,702 wherein the blank is first drawn to a cup having an axial height of approximately one-half the axial height of the final container, afterwhich this container is then redrawn to its full axial length with the desired taper being formed therein during the redraw. Although this method and the apparatus therefor is believed satisfactory, it still requires that the metal blank have a certain thickness in order to maintain container integrity.

Thus, the new method and apparatus of the present invention provides the same nesting features and advantages as that of the above discussed prior art, but which enables a thinner material to be utilized for forming the container by using a material with a greater hardness than heretofore used for such container body manufacture.

SUMMARY OF THE INVENTION

Objectives of the invention is to provide an improved apparatus and method for forming cup shaped containers, such as the container bodies for use in a two-piece container construction, wherein the starting metal strip or sheets have a reduced thickness but has a greater hardness than heretofore used material for forming similar container bodies.

Another objective of the invention is to provide such a method and apparatus in which the container bodies are preferably formed in double acting presses wherein the material is initially drawn into a cup having an axial height approximately one-half the height of the final container body, afterwhich the cup is redrawn at a first redraw station either into a cylindrical first stage container body or a container body having a very slight taper in the sidewall, which is subsequently redrawn at a second redraw station to form a greater taper in the sidewall to provide the desirable nesting feature thereof, and wherein the axial length of the initial container body formed at the first redraw station has the desired axial length as that of the desired final container body, which axial height is unchanged during the second redraw operation and without any substantial change in material thickness throughout the entire forming process.

Still another objective of the invention is to provide such a method and apparatus in which a bottom profile can be applied to the container body, preferably in the second redraw operation.

A still further objective of the invention is to provide such a method and apparatus for forming tapered container bodies, in which the metal material has a Rockwell hardness generally within the range of between 73 and 79, preferably 76, and wherein the final sidewall taper of the container is within the range of between 2° and 4°.

These objectives and advantages are obtained by the improved method of the invention, the general nature of which may be stated as including a method of forming a tapered container body from a metal blank, wherein said container body has a tapered sidewall with a predetermined axial height and an integral bottom wall, including the steps of forming the blank into a cup having a substantially cylindrical sidewall and an integral bottom wall with said sidewall having an axial height less than the predetermined axial height of the container body; redrawing the cup into a first stage container body by redrawing the sidewall and bottom wall by reducing the diameter of the bottom wall and increasing the axial height of the sidewall to a height substantially equal to the said predetermined axial height of the container body while maintaining the metal thickness of the bottom wall and sidewall to that of the metal bland; and redrawing the first stage container body into the container body by imparting a final taper tp said sidewall.

These objectives and advantages are further obtained by the apparatus of the invention which may be stated as including an apparatus for forming a container body from a metal blank having a Rockwell hardness within a range of 73 to 79 and a thickness within a range of 0.0062 to 0.00825 inches and having a tapered sidewall, said apparatus including a draw station for drawing a cup from a disc-shaped blank, said draw station having a draw horn carried by a first punch riser movable a sufficient distance to draw the blank into the cup having a substantially cylindrical sidewall with an axial height at least equal to one-half the final height of the container body; a first redraw station including a first redraw horn carried by a second punch riser movable into the cup a sufficient distance to redraw the cup to the final height; and a second redraw station including a tapered second redraw horn carried by a third punch riser movable into the redrawn cup to impart a final taper to the sidewall without changing the final height thereof.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
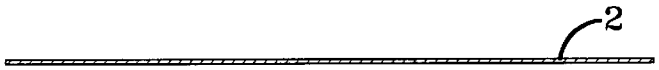
FIG. 1 is a sectional view of the starting disc-shaped blank of sheet metal material from which the container body is subsequently formed.
Figure 2:
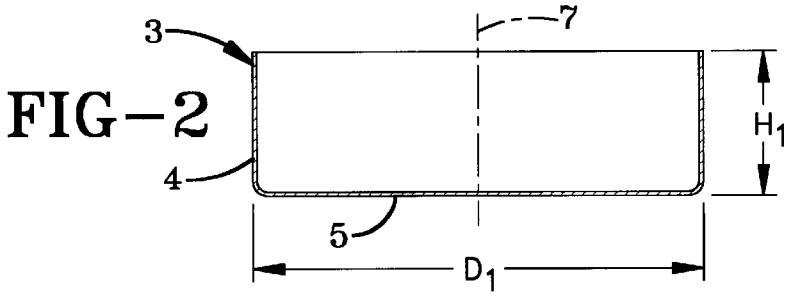
FIG. 2 is a sectional view of the initial cup shaped blank formed in a first draw operation from the disc-shaped blank of FIG. 1.
Figure 3:
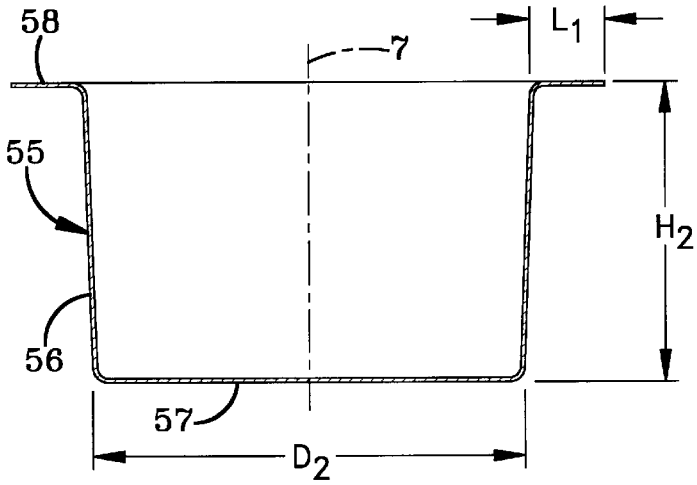
FIG. 3 is a sectional view of the first stage container body formed in a first redraw operation from the cup-shaped blank of FIG. 2.
Figure 4:
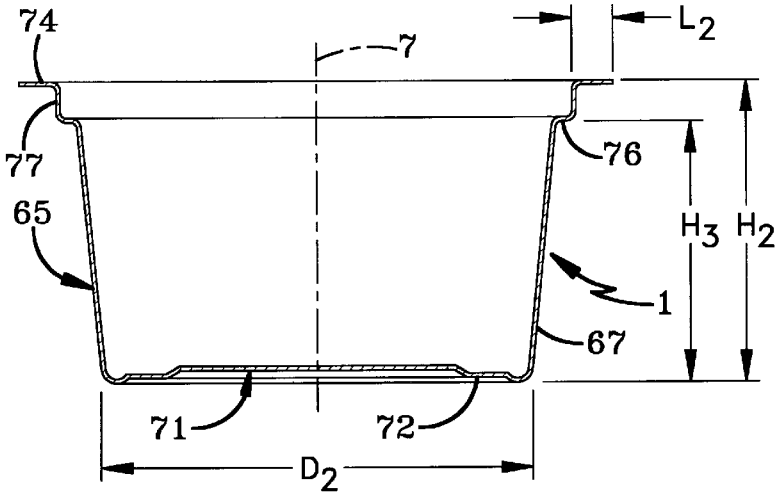
FIG. 4 is a sectional view showing the final tapered container body formed in a second redraw operation from the first stage container body of FIG. 3.

A first embodiment of the improved container body is indicated generally at 1, and is shown in FIG. 4. Before discussing in detail the apparatus of the present invention and the detail steps of the method, reference to FIGS. 1–3 is preferable which shows a starting disc-shaped blank indicated generally at 2 (FIG. 1), which is formed in a usual die press blanking operation discussed more fully below, from either sheets of the desired metal or a strip thereof. Blank 2 is initially drawn into a cup 3 (FIG. 2) which is an integral one-piece member having a substantially cylindrical sidewall 4 with an axial height $H_1$ and a bottom wall 5 with a diameter $D_1$. The thickness of sidewall 4 and bottom wall 5 is the same as the original thickness of blank 2. Cup sidewall 4 will have an axial height less than the final axial height of the container body formed by the method and apparatus of the present invention, and preferably has a height which is equal to or greater than one-half the axial height of the final container body. The central axis of cup 3 is indicated at 7.

Figure 7:
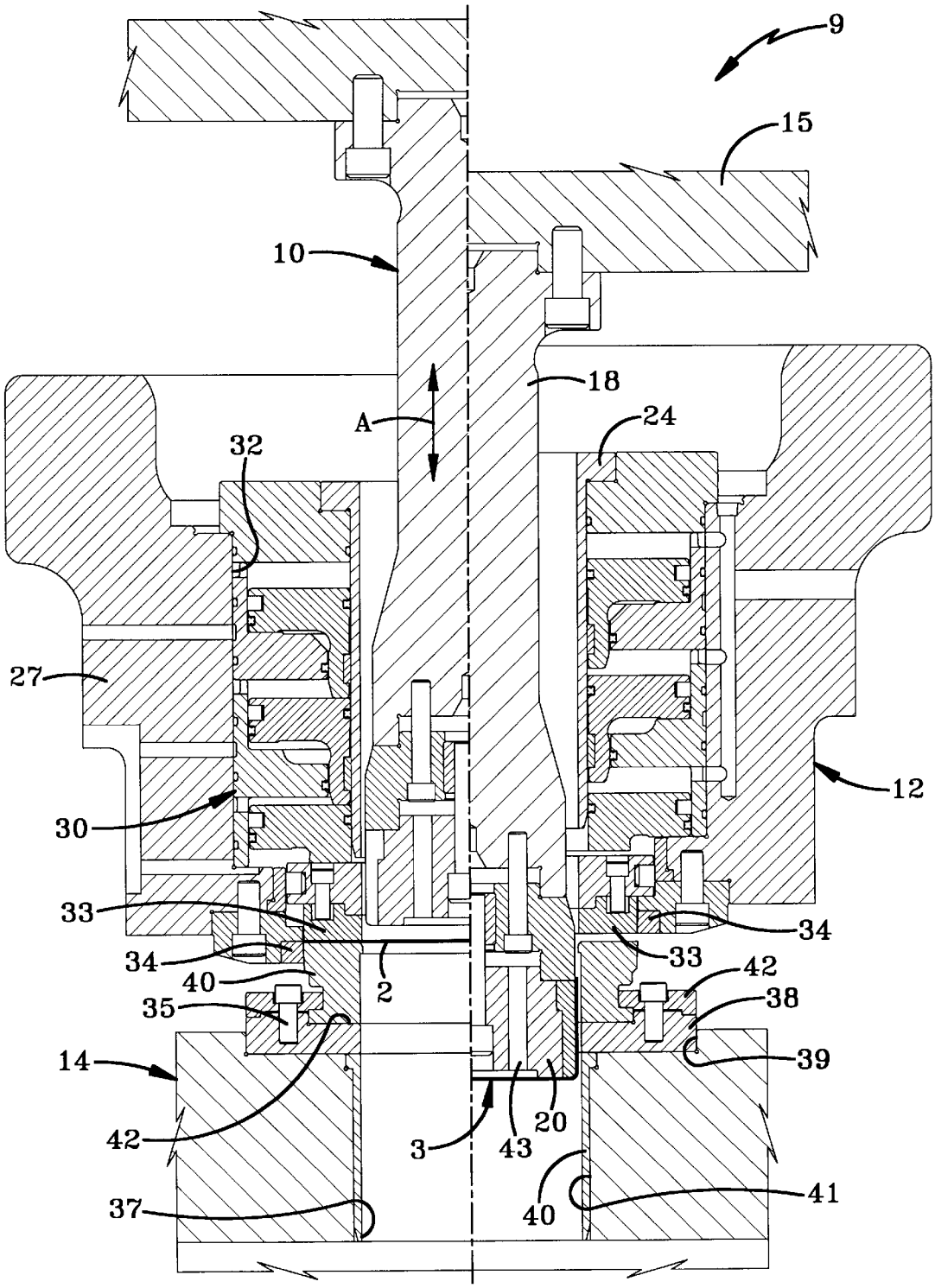
FIG. 7 is a sectional diagrammatic view of the apparatus used for forming the disc-shaped blank of FIG. 1 (left half) and then drawing the initial cup-shaped blank of FIG. 2 (right half)

Blank 2 and cup 3 preferably are formed in a single stroke of a usual double acting press 9 as shown in FIG. 7, which could be of the type shown in U.S. Pat. No. 5,626,048. Apparatus 9 which is shown as a double acting press, has an inner ram 10 and an outer ram 12 movable toward and away from a fixed base 14. Inner ram 10 includes a punch holder 15 to which is secured a punch riser 18. A usual cylindrical draw horn 20 is connected to the bottom of punch riser 18 and moves in a reciprocal vertical direction upon movement of inner ram 10 as shown by arrow A. A cylindrical guide sleeve 24 surrounds draw horn 20. A plurality of annular cylinders 30 are mounted in a vertical stacked relationship within an annular bore 32 of outer ram housing 27 for supplying the clamping pressure on an annular draw pad 33 and a cut ring 34.

Base 14 which is indicated as being a fixed base, could be fluidly supported if desired in order to reduce the forces exerted thereon. A blank and draw retainer ring 38 is mounted within an annular recess 39 formed in base 14 and secures a cup drop sleeve 40 within a cylindrical opening 41. An annular draw die clamp 42 secures an annular blank and draw die 44 into an annular recess 42 formed in retainer ring 38 by a plurality of bolts 35. The various components described above and shown in FIG. 7 are of a usual well known press construction such as shown in U.S. Pat. No. 5,626,048, the contents of which are incorporated herein by reference, but may have other configurations and could be a single acting press without affecting the concept of the invention.

Figure 8:
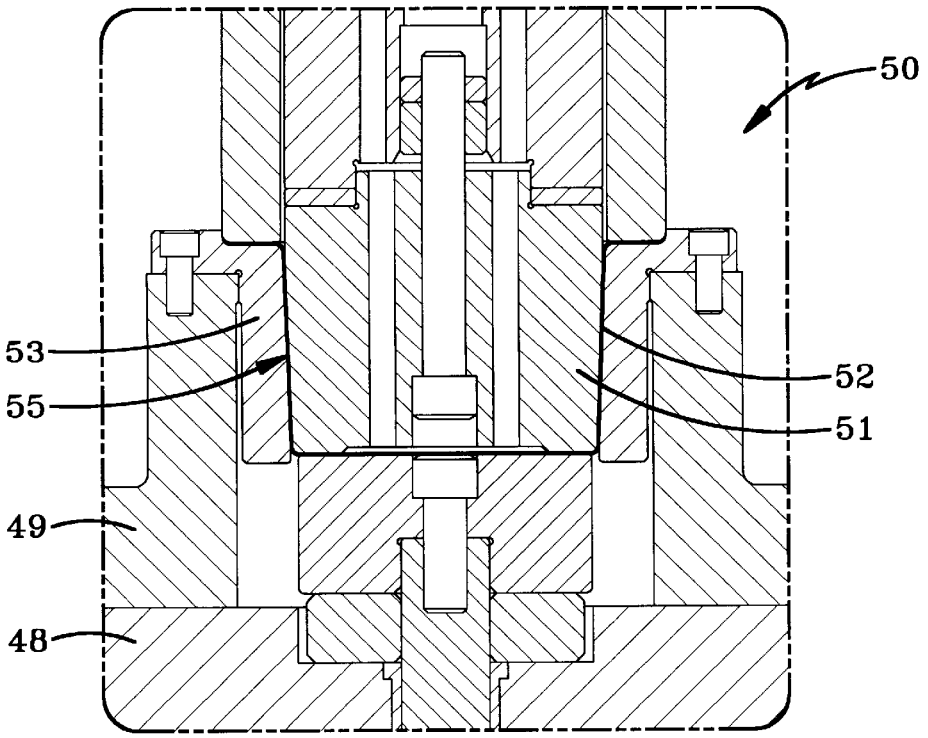
FIG. 8 is an enlarged fragmentary sectional view showing the apparatus at the first redraw station for forming the container body of FIGS. 3 and 5.

The left hand side of FIG. 7 shows cut ring 34 forming blank disc 2 whereupon the advancement of punch riser 18 by inner ram 10 a sufficient distance will draw cup blank 3 to its desired cylindrical configuration. Cup 3 preferably will be ejected through a bottom opening 37 of cup drop sleeve 40 by blasts of pressurized air through openings 43 formed in draw horn 20. The cups are deposited in a container or on a conveyor belt (not shown) for transporting them to a first redraw station indicated at 50, a portion of which is shown in FIG. 8. Redraw station 50 is similar in most respects to apparatus 9 of FIG. 7 and may be a completely separate press having inner and outer rams or may be a portion of apparatus 9 which would include a well known transfer mechanism for transferring cup 3 between a draw horn 51 and a draw die 53 mounted on a support ring 49 which in turn is mounted on a base 48.

Figure 3A:
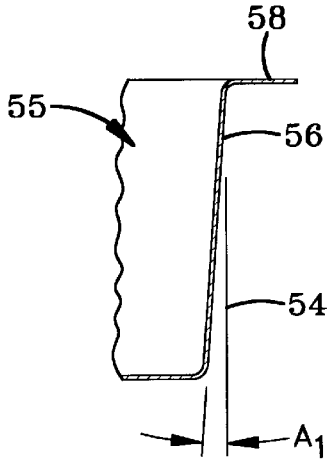
FIG. 3A is a fragmentary sectional view of the right hand end portion of FIG. 3 showing an initial taper imparted to the sidewall of the container body.

At redraw station 50, cup 3 is redrawn by the advancement of draw horn 51, which has a tapered outer annular surface 52, into draw die 53, to form a first stage container body indicated at 55, as shown in FIG. 3. Body 55 is an integral one-piece member having a sidewall 56 and a bottom wall 57 and may include a radially outwardly extending peripheral flange 58, although the same is not required to be formed at this stage of the forming operation. Bottom wall 57 of container body 55 will have a diameter $D_2$, which is formed from the metal of cup bottom wall $D_1$, and will have a diameter equal to or greater than one-half the diameter $D_1$ of cup 3. As shown in FIG. 3A, sidewall 56 preferably has a taper of approximately one degrees as shown by arrow $A_1$ which is measured with respect to a vertical plane 54 which is parallel to axial centerline 7.

Figure 4A:
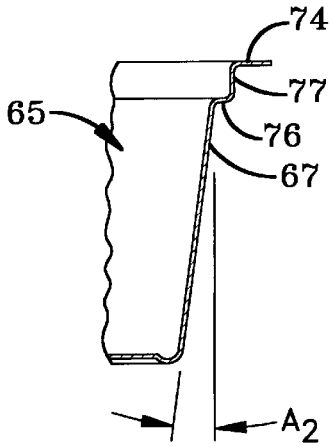
FIG. 4A is a fragmentary sectional view of the right hand end portion of FIG. 4.
Figure 9:
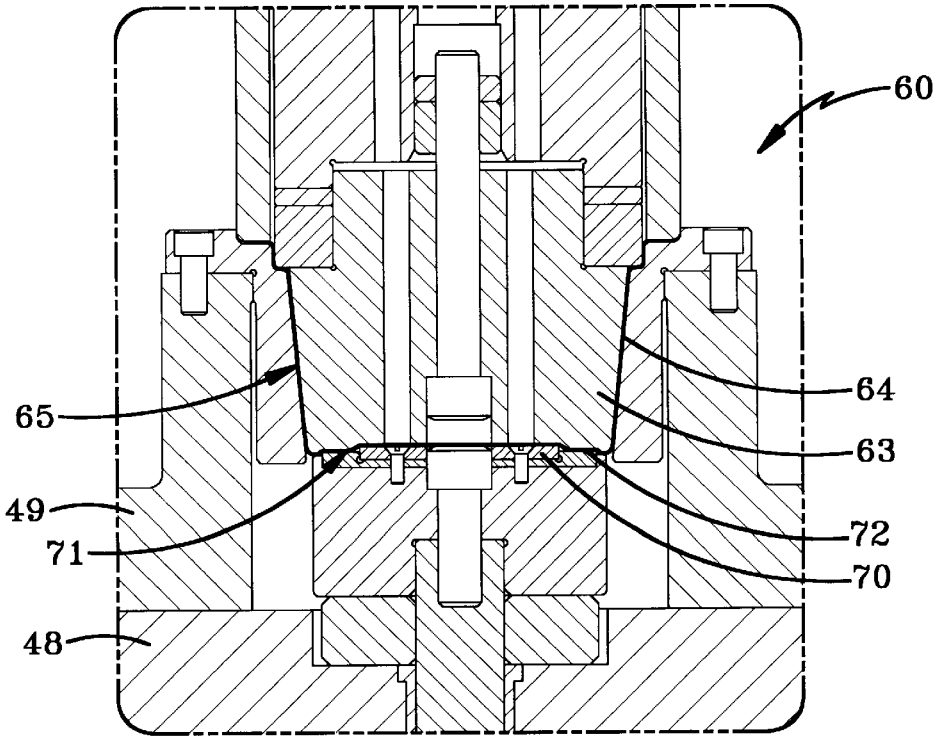
FIG. 9 is a sectional view similar to FIG. 8 showing the apparatus at the second redraw station for forming the final tapered container body of FIG. 4 and 6.

Container body 55 is then removed from first redraw station 50 by transfer mechanisms well known in the art, and transported to a second redraw station indicated at 60 (FIG. 9) which is very similar to redraw station 50. A draw horn 63 has a tapered annular outer surface 64 so as to reform container body 55 into a final container body 65 as shown in FIG. 4, by redrawing container body 55 and in particular sidewall 56 thereof in a second redrawn die 61, to form a sidewall 67 which has a larger taper as shown in FIG. 4A, generally within the range of between two degrees and four degrees and preferably three degrees. The diameter of container body bottom wall 57 is maintained the same in container body 65, and if desired a profile pad or die 70 (FIG. 4) may be used in the second redraw station 60 to form a profile 71 in container body bottom wall 72. Likewise, radial flange 58 of container body 55 may also be redrawn at second redraw station 60 to form a shorter radially outwardly extending flange 74 having a length $L_2$, which preferably is about one-half the length $L_1$ of radial flange 58, and a stepped shoulder 76 and an axially extending wall portion 77 having a diameter greater than that of bottom wall 72 for receiving a usual end closure member (not shown) which is then seamed and sealed thereon after the beverage or food product has been placed in the container body.

Figure 5:
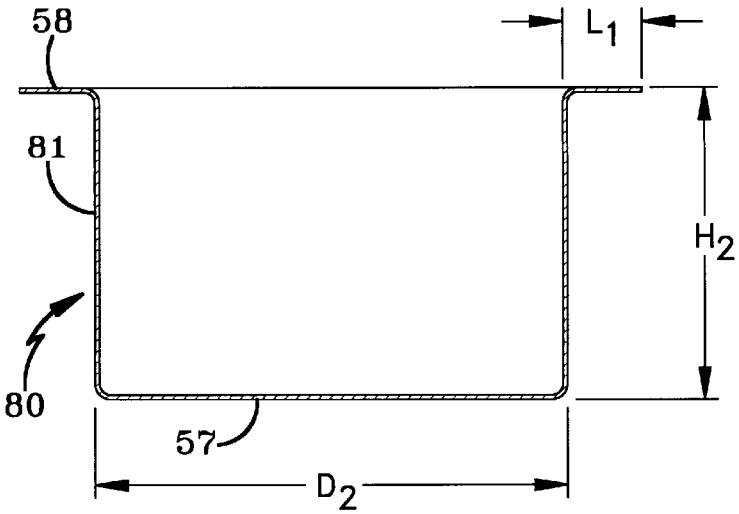
FIG. 5 is a sectional view similar to FIG. 3 showing a slightly modified first stage container body formed at the first redraw station having a substantially cylindrical non-tapered sidewall.
Figure 5A:
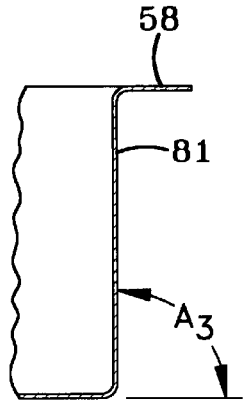
FIG. 5A is a fragmentary sectional view of the right hand end portion of FIG. 5.
Figure 6:
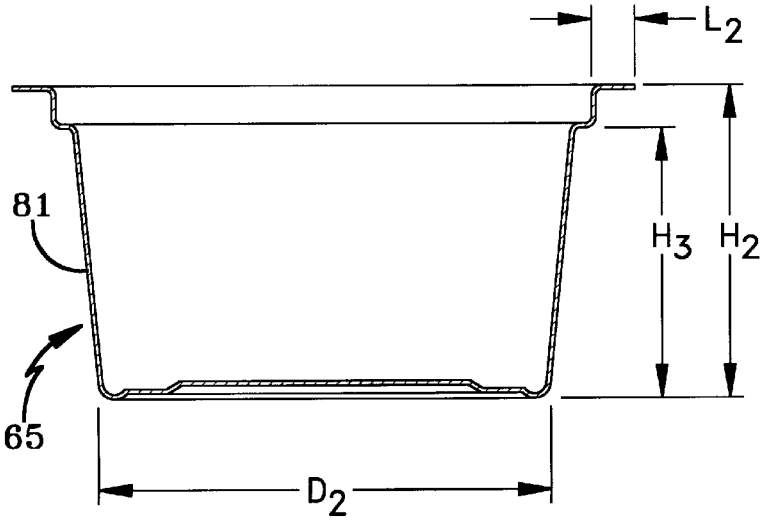
FIG. 6 is a view similar to FIG. 4 showing the final tapered container body formed at a second redraw station from the first redraw container body of FIG. 5.

A slightly modified form of the invention is shown in FIGS. 5–6, wherein cup 3 is formed at a first redraw station into a first stage can body 80 which has a similar bottom wall 57 but a sidewall 81, which preferably is perpendicular to bottom wall 57 as shown by the 90 degree angle $A_3$ in FIG. 5, instead of having a very slight taper imparted thereon as shown in FIG. 3A and described above. Again, the metal thickness of bottom wall 57, sidewall 81 and a radial flange 58 is substantially the same as that of the starting blank 2.

Figure 6A:
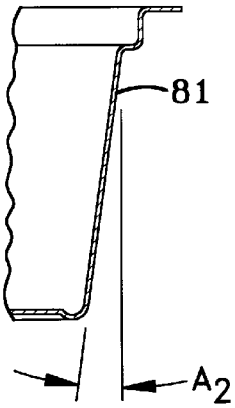
FIG. 6A is a fragmentary sectional view of the right hand end portion of FIG. 6.

Cup 81 is then formed at a second redraw station into the final cup-shaped body 65 shown in FIG. 6, wherein the final taper is imparted to sidewall 81 generally within the range of 2 to 4 degrees, preferably 3 degrees, as shown in FIG. 6A by arrow $A_2$.

In accordance with one of the main features of the invention, the initial metal material from which blank 2 is formed, is of the type referred to in the industry as DR9 which is a double reduced material and which will have a Rockwell hardness generally within the range of 73 to 79 with a preferred mean hardness of 76. This will have an approximate longitudinal yield strength within the range of 85 and 105 ksi and a thickness of generally 0.00825 inches. A metal having this thickness and hardness would not be satisfactory for forming tapered container bodies with the prior art processes due to excessive wrinkling and possible fracture. However, the particular method and apparatus of the present invention shown in the drawings and described above, has been found to achieve the desired final tapered container body with the use of this harder and thinner material by the unique method steps discussed above. This type of starting material is less costly than the heretofore used softer and thicker material thereby resulting in a cost reduction for the can body making said subsequent food/beverage processor.

In the preferred embodiment of FIGS. 2–4A, $D_1$ is approximately 3½ inches and $H_1$ is within the range of 1 and 1¼ inches; $D_2$ is approximately 2½ inches and $H_2$ is approximately 2 inches with $L_1$ being approximately ¼ inches; and $H_3$ is approximately ⅛ inches and $L_2$ is approximately ⅛ inches.

In summary, the apparatus and method of the present invention enables tapered can bodies to be formed with a thinner and harder material than heretofore possible with known apparatus and methods of forming tapered containers due to the unique steps and apparatus therefor discussed above.

Accordingly, the improved method and apparatus for forming tapered metal containers is simplified, provides an effective, safe, inexpensive, and efficient device and method steps which achieve all the enumerated objectives, provide for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved method and apparatus for forming tapered metal containers is construed and used, the characteristics of the construction, and the advantageous, new and useful results obtained; the new and useful structures, devices, elements, arrangements, parts and combinations and method steps, are set forth in the appended claims.

I claim:

1. A method of forming a tapered container body from a metal blank, wherein said container body has a tapered sidewall with a predetermined axial height and an integral bottom wall, including the steps of:

A) forming the blank into a cup having a substantially cylindrical sidewall and an integral bottom wall with said sidewall having an axial height less than the predetermined axial height of the container body;

B) redrawing the cup into a first stage container body by redrawing the sidewall and bottom wall by reducing the diameter of the bottom wall and increasing the axial height of the sidewall to a height substantially equal to the said predetermined axial height of the container body while maintaining the metal thickness of the bottom wall and sidewall to that of the metal blank; and C) redrawing the first stage container body into the container body by imparting a final taper to said sidewall.

2. The method defined in claim 1 including the step of imparting a partial taper to the sidewall of the first stage container body when performing Step B.

3. The method defined in claim 2 wherein the degree of the partial taper is approximately one degree (1°) from a vertical plane parallel to an axial centerline of the cup.

4. The method defined in claim 1 including the step of forming an annular radial flange extending outwardly from an open end of the first stage container body opposite of the bottom wall.

5. The method defined in claim 4 including the step of reforming the radial flange and an adjacent portion of the sidewall to form a stepped shoulder extending between the tapered sidewall and said radial flange.

6. The method defined in claim 5 wherein the reformed radial flange has a shorter radial length than when formed during Step B.

7. The method defined in claim 1 including the step of profiling the bottom wall of the cup.

8. The method defined in claim 7 wherein the bottom wall is profiled during Step C.

9. The method defined in claim 1 wherein the final degree of taper achieved in Step C is generally within the range of two degrees (2°) and four degrees (4°) from a vertical plane parallel to an axial centerline of the cup.

10. The method defined in claim 9 wherein the final degree of taper achieved in Step C is generally three degrees (3°).

11. The method defined in claim 1 wherein the bottom wall has a diameter which remains substantially constant throughout Steps B and C.

12. The method defined in claim 1 wherein the metal blank has a Rockwell hardness generally within the range of 73 and 79.

13. The method defined in claim 12 wherein the metal blank has a Rockwell hardness of 76.

14. The method defined in claim 12 wherein the metal blank has a longitudinal yield strength generally within the range of 85–105 ksi.

15. The method defined in claim 1 wherein the metal blank has a thickness of generally 0.0062 to 0.00825 inches.

16. The method defined in claim 1 wherein the predetermined axial height is approximately two inches.

17. The method defined in claim 16 wherein the diameter of the body wall of the container body is approximately 2½ inches.

18. Apparatus for forming a container body from a metal blank having a Rockwell hardness within a range of 73 to 79 and a thickness within a range of 0.0062 to 0.00825 inches and having a tapered sidewall, said apparatus including:

A) a draw station for drawing a cup from a disc-shaped blank, said draw station having a draw horn carried by a first punch riser movable a sufficient distance to draw the blank into the cup having a substantially cylindrical sidewall with an axial height at least equal to one-half the final height of the container body;

B) a first redraw station including a first redraw horn carried by a second punch riser movable into the cup a sufficient distance to redraw the cup to the final height; and C) a second redraw station including a tapered second redraw horn carried by a third punch riser movable into the redrawn cup to impart a final taper to the sidewall without changing the final height thereof.

19. The apparatus defined in claim 18 wherein the first redraw horn is tapered less than the taper of the second redraw horn.

20. The apparatus defined in claim 19 wherein the first redraw horn has a taper of approximately 1° and the second redraw horn has a taper of approximately 3°.

21. The apparatus defined in claim 18 wherein the second redraw station includes a bottom profile die for profiling the bottom wall of the container body.

* * * * *